US012736050B2

(12) United States Patent
Ueda et al.

(10) Patent No.: US 12,736,050 B2
(45) Date of Patent: Sep. 15, 2026

(54) SCROLL COMPRESSOR

(71) Applicant: KABUSHIKI KAISHA TOYOTA JIDOSHOKKI, Aichi-ken (JP)

(72) Inventors: Tomoya Ueda, Kariya (JP); Takuro Yamashita, Kariya (JP); Yuki Nagahara, Kariya (JP); Tomoharu Arai, Kariya (JP); Tsubasa Mitsui, Kariya (JP); Kunihisa Matsuda, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 19/392,349

(22) Filed: Nov. 18, 2025

(65) Prior Publication Data

US 2026/0146604 A1 May 28, 2026

(30) Foreign Application Priority Data

Nov. 22, 2024 (JP) ..... 2024-203937

(51) Int. Cl.
*F04C 18/02* (2006.01)
*F04C 29/02* (2006.01)

(52) U.S. Cl.
CPC ..... *F04C 18/0215* (2013.01); *F04C 29/023* (2013.01); *F04C 2240/30* (2013.01)

(58) Field of Classification Search
None
See application file for complete search history.

(56) References Cited

U.S. PATENT DOCUMENTS

2022/0235771 A1* 7/2022 Yamamoto ..... F04C 18/0215

FOREIGN PATENT DOCUMENTS

JP H09-42178 A 2/1997
JP 2022152796 A * 10/2022

* cited by examiner

*Primary Examiner* — Kenneth J Hansen
(74) *Attorney, Agent, or Firm* — Greenblum & Bernstein, P.L.C.

(57) ABSTRACT

A discharge housing peripheral wall includes an inner surface that defines an annular passage. The inner surface includes a lower portion located vertically below an axis of a rotary shaft of a scroll compressor. As the annular passage is viewed in the axial direction of the rotary shaft, a region of the annular passage vertically below the fourth straight line is a liquid refrigerant reservoir. The liquid refrigerant reservoir is configured to store liquid refrigerant generated by condensation of refrigerant in the annular passage while limiting suction of the liquid refrigerant from the annular passage into a compression chamber through a second suction hole. The second suction hole is located in a portion of the fixed peripheral wall that is positioned vertically above the liquid refrigerant reservoir.

8 Claims, 2 Drawing Sheets

SCROLL COMPRESSOR

CROSS-REFERENCE TO RELATED APPLICATIONS

This application is based upon and claims the benefit of priority from Japanese Patent Application No. 2024-203937, filed on Nov. 22, 2024, the entire contents of which are incorporated herein by reference.

BACKGROUND

1. Field

The present disclosure relates to a scroll compressor.

2. Description of Related Art

JP2022-152796 discloses an example of a scroll compressor that includes a rotary shaft, a compression mechanism, and a housing. The compression mechanism is driven by rotation of the rotary shaft. The compression mechanism includes a compression chamber for compressing refrigerant. The housing includes a suction chamber, a discharge chamber, and a suction passage. Refrigerant is drawn into the suction chamber from outside. The refrigerant compressed in the compression chamber is discharged to the discharge chamber. The refrigerant in the suction chamber is drawn into the compression chamber through the suction passage.

The compression mechanism includes a fixed scroll and an orbiting scroll. The fixed scroll is fixed to the housing. The fixed scroll includes a fixed base plate, a fixed volute wall, and a fixed peripheral wall. The fixed volute wall extends from the fixed base plate in the axial direction of the rotary shaft. The fixed peripheral wall extends from the fixed base plate in the axial direction of the rotary shaft and surrounds the fixed volute wall. The orbiting scroll includes an orbiting base plate and an orbiting volute wall. The orbiting base plate is opposed to the fixed base plate. The orbiting volute wall extends toward the fixed base plate from the orbiting base plate. The orbiting volute wall meshes with the fixed volute wall. The compression chamber is defined by the fixed base plate, the fixed volute wall, the orbiting base plate, and the orbiting volute wall. As the rotary shaft rotates, the orbiting scroll orbits inside the fixed peripheral wall.

The housing includes a shaft support housing member and a discharge housing member. The shaft support housing member is disposed on the opposite side of the orbiting base plate from the fixed base plate. The shaft support housing member supports the rotary shaft. The discharge housing member includes a discharge housing end wall and a discharge housing peripheral wall. The discharge housing peripheral wall is cylindrical, and extends from the discharge housing end wall. The discharge housing peripheral wall surrounds the fixed peripheral wall. The discharge housing member defines the discharge chamber between the discharge housing end wall and the fixed base plate.

The suction passage includes a first suction hole, an annular passage, and a second suction hole. The first suction hole is located in the shaft support housing member. The first suction hole is connected to the suction chamber. The annular passage is located between the fixed peripheral wall and the discharge housing peripheral wall. The annular passage is connected to the first suction hole. The second suction hole is located in the fixed peripheral wall. The second suction hole is connected to the annular passage. The refrigerant in the suction chamber is drawn into the compression chamber through the first suction hole, the annular passage, and the second suction hole.

In the scroll compressor disclosed in the above-described publication, the refrigerant in the annular passage may be cooled and condensed when the scroll compressor is stopped. When the liquid refrigerant generated by the condensation of the refrigerant in the annular passage is drawn into the compression chamber through the second suction hole upon startup of the scroll compressor, liquid compression may occur in the compression chamber. When liquid compression occurs in the compression chamber, the pressure in the compression chamber may become abnormally high. In that case, the durability of the compression mechanism deteriorates, leading to a reduction in the reliability of the scroll compressor.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A scroll compressor according to an aspect of the present disclosure includes a rotary shaft, a compression mechanism configured to be driven by rotation of the rotary shaft, the compression mechanism including a compression chamber configured to compress refrigerant, and a housing rotatably supporting the rotary shaft, the housing including a suction chamber into which refrigerant is drawn from outside, a discharge chamber from which the refrigerant compressed in the compression chamber is discharged, and a suction passage through which the refrigerant drawn from the suction chamber into the compression chamber passes. The compression mechanism includes a fixed scroll fixed to the housing, the fixed scroll including a fixed base plate, a fixed volute wall extending from the fixed base plate in an axial direction of the rotary shaft, and a fixed peripheral wall extending from the fixed base plate in the axial direction of the rotary shaft and surrounding the fixed volute wall, and an orbiting scroll configured to orbit inside the fixed peripheral wall in response to rotation of the rotary shaft, the orbiting scroll including an orbiting base plate opposing the fixed base plate and an orbiting volute wall extending from the orbiting base plate toward the fixed base plate and meshing with the fixed volute wall. The compression chamber is defined by the fixed base plate, the fixed volute wall, the orbiting base plate, and the orbiting volute wall. The housing includes a shaft support housing member that is disposed on an opposite side of the orbiting base plate from the fixed base plate and supports the rotary shaft, and a discharge housing member including a discharge housing end wall and a cylindrical discharge housing peripheral wall extending from the discharge housing end wall to surround the fixed peripheral wall, the discharge housing member defining the discharge chamber between the discharge housing end wall and the fixed base plate. The suction passage includes a first suction hole located in the shaft support housing member and connected to the suction chamber, an annular passage located between the fixed peripheral wall and the discharge housing peripheral wall and connected to the first suction hole, and a second suction hole located in the fixed peripheral wall and connected to the annular passage. The discharge housing peripheral wall includes an inner surface that defines the annular passage. The inner surface including a lower portion located vertically below an axis of the rotary shaft. As viewed in the axial direction of the rotary shaft, a straight line intersecting the axis of the rotary shaft and extending vertically is a first straight line. As viewed in the axial direction of the rotary shaft, a straight line intersecting the axis of the rotary shaft and extending with an inclination of 30 degrees toward one side in a circumferential direction of the rotary shaft with respect to the first straight line is a second straight line. As viewed in the axial direction of the rotary shaft, a straight line intersecting the axis of the rotary shaft and extending with an inclination of 30 degrees toward the other side in the circumferential direction of the rotary shaft with respect to the first straight line is a third straight line. As viewed in the axial direction of the rotary shaft, an intersection of the lower portion of the inner surface and the second straight line is a first intersection. As viewed in the axial direction of the rotary shaft, an intersection of the lower portion of the inner surface and the third straight line is a second intersection. As viewed in the axial direction of the rotary shaft, a straight line passing through the first intersection and the second intersection and extending horizontally is a fourth straight line. As the annular passage is viewed in the axial direction of the rotary shaft, a region of the annular passage vertically below the fourth straight line is a liquid refrigerant reservoir. The liquid refrigerant reservoir is configured to store liquid refrigerant generated by condensation of the refrigerant in the annular passage while limiting suction of the liquid refrigerant from the annular passage into the compression chamber through the second suction hole. The second suction hole is located in a portion of the fixed peripheral wall that is positioned vertically above the liquid refrigerant reservoir.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

An embodiment of a scroll compressor will now be described with reference to FIGS. 1 and 2. The scroll compressor of the present embodiment is used in, for example, a vehicle air conditioner.

Basic Configuration of Scroll Compressor

Figure 1:
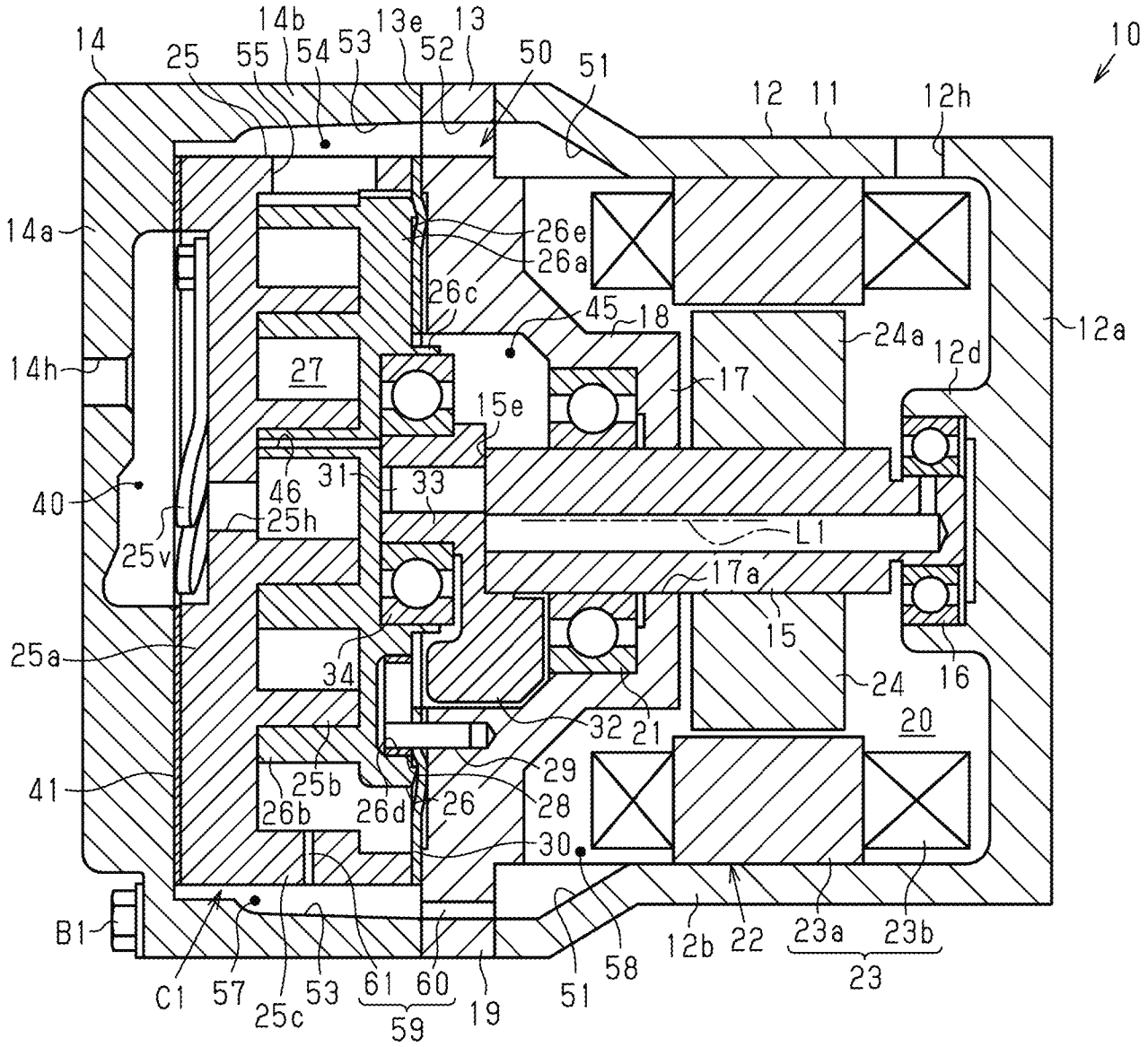
FIG. 1 is a cross-sectional view of a scroll compressor according to an embodiment.

As shown in FIG. 1, the scroll compressor 10 includes a cylindrical housing 11. The housing 11 includes a motor housing member 12, a shaft support housing member 13, and a discharge housing member 14. The motor housing member 12, the shaft support housing member 13, and the discharge housing member 14 are made of metal. The motor housing member 12, the shaft support housing member 13, and the discharge housing member 14 are made of, for example, aluminum. The scroll compressor 10 includes a rotary shaft 15. The rotary shaft 15 is accommodated in the housing 11.

The motor housing member 12 includes a plate-shaped motor housing end wall 12*a* and a cylindrical motor housing peripheral wall 12*b*. The cylindrical motor housing peripheral wall 12*b* extends from the outer periphery of the motor housing end wall 12*a*. The axial direction of the motor housing peripheral wall 12*b* coincides with the axial direction of the rotary shaft 15.

The motor housing member 12 includes a suction port 12*h*. Refrigerant is drawn from outside through the suction port 12*h*. The suction port 12*h* is located in a portion of the motor housing peripheral wall 12*b* relatively close to the motor housing end wall 12*a*. The suction port 12*h* connects the inside and the outside of the motor housing member 12.

The motor housing member 12 includes a cylindrical boss 12*d*. The boss 12*d* protrudes from a central portion of the inner surface of the motor housing end wall 12*a*. The rotary shaft 15 includes a first end, which is one end in its axial direction, and a second end, which is the other end in the axial direction. The first end of the rotary shaft 15 is inserted into the boss 12*d*.

The scroll compressor 10 includes a bearing 16. The bearing 16 is, for example, a rolling-element bearing. The bearing 16 is disposed between the inner peripheral surface of the boss 12*d* and the outer peripheral surface of the first end of the rotary shaft 15. The first end of the rotary shaft 15 is rotatably supported by the motor housing member 12 via a bearing 16.

The shaft support housing member 13 includes a plate-shaped shaft support housing end wall 17 and a cylindrical shaft support housing peripheral wall 18. The cylindrical shaft support housing peripheral wall 18 extends from the outer periphery of the shaft support housing end wall 17. The axial direction of the shaft support housing peripheral wall 18 coincides with the axial direction of the rotary shaft 15.

The shaft support housing member 13 includes an annular flange wall 19. The flange wall 19 extends outward in the radial direction of the rotary shaft 15 from an end of the outer surface of the shaft support housing peripheral wall 18 located opposite the shaft support housing end wall 17.

The shaft support housing member 13 includes a circular insertion hole 17*a*. The insertion hole 17*a* is located in a central portion of the shaft support housing end wall 17. The insertion hole 17*a* is inserted through the shaft support housing end wall 17 in its thickness direction. The rotary shaft 15 extends through the insertion hole 17*a*. The second end of the rotary shaft 15 includes an end face 15*e*. The end face 15*e* is located inside the shaft support housing peripheral wall 18.

The scroll compressor 10 includes a bearing 21. The bearing 21 is, for example, a rolling-element bearing. The bearing 21 is located between the inner surface of the shaft support housing peripheral wall 18 and the outer peripheral surface of the rotary shaft 15. The rotary shaft 15 is rotatably supported by the shaft support housing member 13 via the bearing 21. Accordingly, the shaft support housing member 13 rotatably supports the rotary shaft 15. Thus, the housing 11 rotatably supports the rotary shaft 15.

The scroll compressor 10 includes a motor chamber 20. The motor chamber 20 is defined by the motor housing member 12 and the shaft support housing member 13. Specifically, the motor chamber 20 is defined by the opening of the motor housing peripheral wall 12*b* being closed by the shaft support housing member 13. Accordingly, when the opening of the motor housing peripheral wall 12*b* is closed by the shaft support housing member 13, the motor housing member 12 defines the motor chamber 20 together with the shaft support housing member 13. Thus, the housing 11 includes the motor chamber 20. The motor chamber 20 is connected to the suction port 12*h*. Refrigerant is drawn into the motor chamber 20 through the suction port 12*h*. Thus, the motor chamber 20 is a suction chamber into which refrigerant is drawn from outside.

The scroll compressor 10 includes a motor 22. The motor 22 is accommodated in the motor chamber 20. Thus, the motor chamber 20 accommodates the motor 22. The motor 22 includes a cylindrical stator 23 and a cylindrical rotor 24. The rotor 24 is arranged inside the stator 23. The rotor 24 rotates integrally with the rotary shaft 15. The stator 23 surrounds the rotor 24. The rotor 24 includes a rotor core 24*a*, which is fixed to the rotary shaft 15, and permanent magnets (not shown), which are arranged on the rotor core 24*a*.

The stator 23 includes a cylindrical stator core 23*a* and a motor coil 23*b*. The stator core 23*a* is fixed to the inner surface of the motor housing peripheral wall 12*b*. The motor coil 23*b* is wound around the stator core 23*a*. When the power controlled by an inverter (not shown) is supplied to the motor coil 23*b*, the rotor 24 rotates. This rotates the rotary shaft 15 integrally with the rotor 24. Thus, the motor 22 rotates the rotary shaft 15.

The scroll compressor 10 includes a compression mechanism C1. The compression mechanism C1 includes a fixed scroll 25 and an orbiting scroll 26. The compression mechanism C1 is of a scroll type. The compression mechanism C1 is driven by rotation of the rotary shaft 15.

The fixed scroll 25 has a fixed base plate 25*a*, a fixed volute wall 25*b*, and a fixed peripheral wall 25*c*. The fixed base plate 25*a* is disc-shaped. The fixed base plate 25*a* includes a discharge port 25*h* at the center. The discharge port 25*h* is circular. The discharge port 25*h* extends through the fixed base plate 25*a* in its thickness direction. The fixed volute wall 25*b* extends from the fixed base plate 25*a* in the axial direction of the rotary shaft 15. The fixed peripheral wall 25*c* extends in the axial direction of the rotary shaft 15 from the outer periphery of the fixed base plate 25*a*. The fixed peripheral wall 25*c* surrounds the fixed volute wall 25*b*.

The scroll compressor 10 includes a valve mechanism 25*v*. The valve mechanism 25*v* is attached to an end face of the fixed base plate 25*a* located opposite the fixed volute wall 25*b*. The valve mechanism 25*v* is configured to selectively open and close the discharge port 25*h*.

The orbiting scroll 26 includes an orbiting base plate 26*a* and an orbiting volute wall 26*b*. The orbiting base plate 26*a* is disc-shaped. The orbiting base plate 26*a* faces the fixed base plate 25*a*. The orbiting volute wall 26*b* extends from the orbiting base plate 26*a* toward the fixed base plate 25*a*. The orbiting volute wall 26*b* meshes with the fixed volute wall 25*b*. The orbiting scroll 26 is located inside the fixed peripheral wall 25*c*. In response to rotation of the rotary shaft 15, the orbiting scroll 26 orbits inside the fixed peripheral wall 25*c*. The fixed volute wall 25*b* includes a distal surface that is in contact with the orbiting base plate 26*a*. The orbiting volute wall 26*b* includes a distal surface that is in contact with the fixed base plate 25*a*.

The scroll compressor 10 includes a compression chamber 27. The compression chamber 27 is defined by the fixed base plate 25*a*, the fixed volute wall 25*b*, the orbiting base plate 26*a*, and the orbiting volute wall 26*b*. Accordingly, the compression chamber 27 is defined between the fixed scroll 25 and the orbiting scroll 26. Thus, the compression mechanism C1 includes the compression chamber 27. The compression chamber 27 draws in and compresses the refrigerant from outside.

The orbiting base plate 26*a* includes a cylindrical boss 26*c*. The boss 26*c* protrudes from an end face 26*e* of the orbiting base plate 26*a* on the side opposite the fixed base plate 25*a* toward the inside of the shaft support housing peripheral wall 18 of the shaft support housing member 13. The shaft support housing member 13 is disposed on the side opposite side of the orbiting base plate 26*a* from the fixed base plate 25*a*. The axial direction of the boss 26*c* coincides with the axial direction of the rotary shaft 15. The orbiting base plate 26*a* includes grooves 26*d*. The grooves 26*d* are located around the boss 26*c* in the end face 26*e* of the orbiting base plate 26*a*. The grooves 26*d* are arranged at predetermined intervals in the circumferential direction of the rotary shaft 15. For illustrative purposes, only one of the grooves 26*d* is illustrated in FIG. 1. An annular ring member 28 is fitted in each groove 26*d*. A pin 29 is inserted into each ring member 28. Each pin 29 protrudes into the ring member 28 from the end face 13*e* of the shaft support housing member 13 facing the orbiting scroll 26.

The scroll compressor 10 includes an annular elastic plate 30. The outer periphery of the elastic plate 30 is held between an opening end face of the fixed peripheral wall 25*c* and the end face 13*e* of the shaft support housing member 13. The elastic plate 30 constantly urges the orbiting scroll 26 toward the fixed scroll 25.

The scroll compressor 10 includes an eccentric shaft 31. The eccentric shaft 31 protrudes toward the orbiting scroll 26 from a position of the end face 15*e* of the rotary shaft 15 that is eccentric from the axis L1 of the rotary shaft 15. The eccentric shaft 31 is formed integrally with the rotary shaft 15. The axial direction of the eccentric shaft 31 coincides with the axial direction of the rotary shaft 15. The eccentric shaft 31 is inserted into the boss 26*c*.

The scroll compressor 10 includes a balancing weight 32 and a bushing 33. The bushing 33 is fitted to an outer peripheral surface of the eccentric shaft 31. The balancing weight 32 is integrated with the bushing 33. The balancing weight 32 is formed integrally with the bushing 33. The balancing weight 32 is accommodated in a space provided in the shaft support housing peripheral wall 18. The orbiting scroll 26 is supported by the eccentric shaft 31 via the bushing 33 and the rolling-element bearing 34 so as to be rotatable relative to the eccentric shaft 31.

Rotation of the rotary shaft 15 is transmitted to the orbiting scroll 26 via the eccentric shaft 31, the bushing 33, and the rolling-element bearing 34. This causes the orbiting scroll 26 to rotate. When each pin 29 comes into contact with the inner peripheral surface of the corresponding ring member 28, the rotation of the orbiting scroll 26 is hindered, while only the orbital motion of the orbiting scroll 26 is allowed. Thus, the orbiting scroll 26 orbits while the orbiting volute wall 26*b* is in contact with the fixed volute wall 25*b*. As the orbiting scroll 26 undergoes orbital motion, the volume of each compression chamber 27 decreases, so that the refrigerant is compressed in the compression chamber 27. In response to rotation of the rotary shaft 15, the orbiting scroll 26 orbits inside the fixed peripheral wall 25*c*. The balancing weight 32 offsets the centrifugal force acting on the orbiting scroll 26 when the orbiting scroll 26 orbits. This reduces the magnitude of unbalance of the orbiting scroll 26.

The discharge housing member 14 includes a plate-shaped discharge housing end wall 14*a* and a cylindrical discharge housing peripheral wall 14*b*. The cylindrical discharge housing peripheral wall 14*b* extends from the outer periphery of the discharge housing end wall 14*a*. The axial direction of the discharge housing peripheral wall 14*b* coincides with the axial direction of the rotary shaft 15. The discharge housing peripheral wall 14*b* surrounds the fixed peripheral wall 25*c*. Accordingly, the discharge housing peripheral wall 14*b* surrounds the fixed scroll 25. Thus, the fixed scroll 25 is accommodated in the housing 11.

Figure 2:
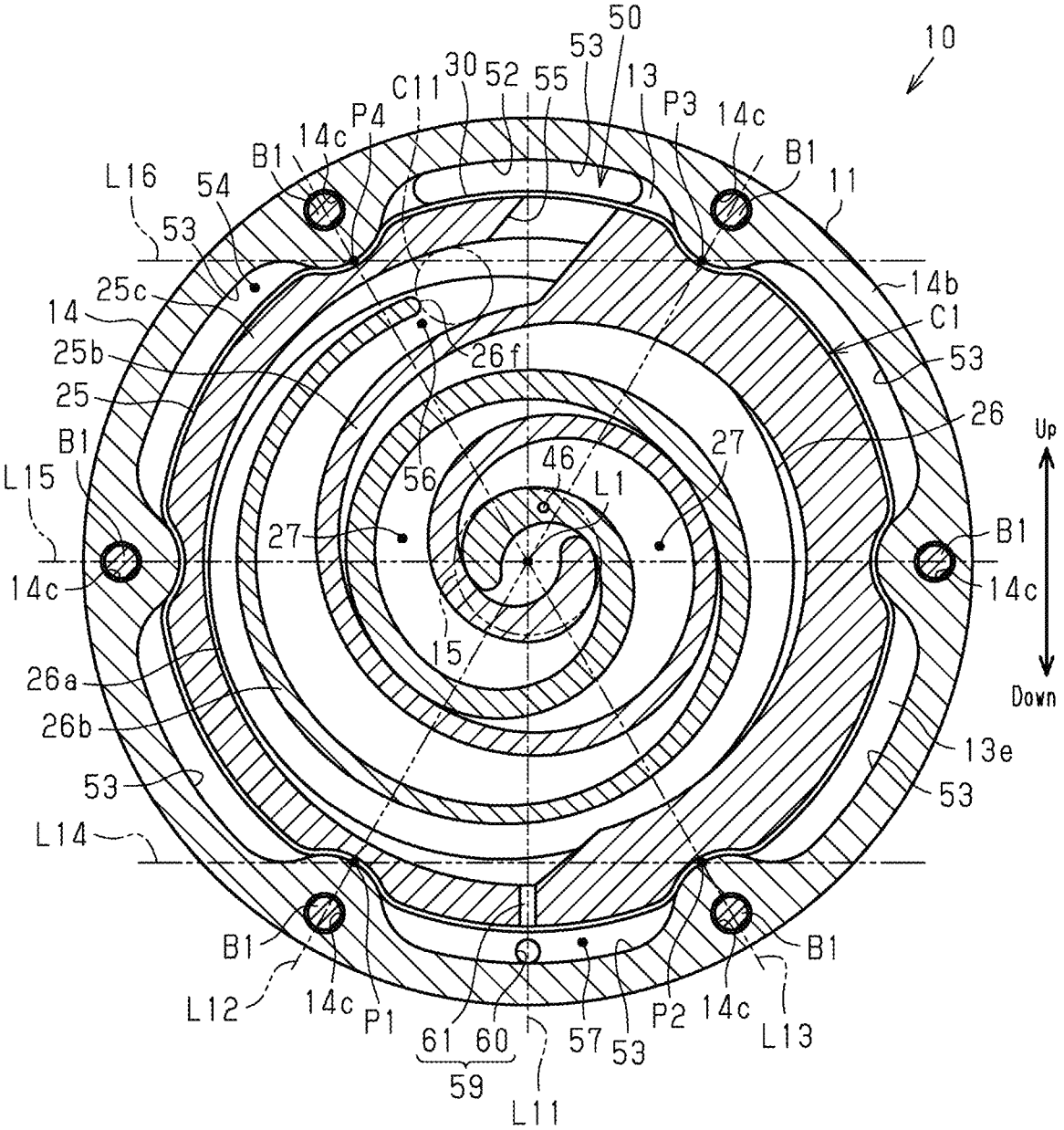
FIG. 2 is a cross-sectional view of the scroll compressor shown in FIG. 1, taken along a different plane.

As shown in FIG. 2, the discharge housing member 14 includes bolt insertion holes 14*c*. The discharge housing member 14 includes six bolt insertion holes 14*c*. Each bolt insertion hole 14*c* extends through the discharge housing peripheral wall 14*b* in the axial direction of the discharge housing peripheral wall 14*b*.

A bolt B1 inserted into each bolt insertion hole 14*c* extends through the flange wall 19 and is threaded into the motor housing member 12. Thus, as shown in FIG. 1, the shaft support housing member 13 is coupled to the motor housing peripheral wall 12*b*, and the discharge housing member 14 is coupled to the motor housing peripheral wall 12*b* by the flange wall 19 of the shaft support housing member 13. The motor housing member 12, the shaft support housing member 13, and the discharge housing member 14 are arranged in this order in the axial direction of the rotary shaft 15. The flange wall 19 of the shaft support housing member 13 is sandwiched between the discharge housing peripheral wall 14*b* and the motor housing peripheral wall 12*b*.

The fixed peripheral wall 25*c* of the fixed scroll 25 is sandwiched between the discharge housing end wall 14*a* and the shaft support housing member 13 in the axial direction of the discharge housing peripheral wall 14*b* by an axial force of each bolt B1. Thus, when the fixed peripheral wall 25*c* is sandwiched between the discharge housing end wall 14*a* and the shaft support housing member 13 in the axial direction of the discharge housing peripheral wall 14*b* by an axial force of each bolt B1, the fixed scroll 25 is fixed to the housing 11.

The scroll compressor 10 includes a discharge chamber 40. The discharge chamber 40 is defined between the discharge housing end wall 14*a* and the fixed base plate 25*a*. Accordingly, the discharge housing member 14 defines the discharge chamber 40 between the discharge housing end wall 14*a* and the fixed base plate 25*a*. Thus, the housing 11 includes the discharge chamber 40. The refrigerant compressed in the compression chamber 27 is discharged to the discharge chamber 40 through the discharge port 25*h*. A portion around the discharge chamber 40 between the discharge housing end wall 14*a* of the discharge housing member 14 and the fixed base plate 25*a* is sealed by a gasket 41.

The discharge housing member 14 includes a discharge port 14*h*. The discharge port 14*h* is located in the discharge housing end wall 14*a*. The discharge port 14*h* is connected to the discharge chamber 40. Refrigerant is discharged out of the discharge chamber 40 through the discharge port 14*h*.

Back-Pressure Chamber

A back-pressure chamber 45 is defined between the orbiting base plate 26*a* of the orbiting scroll 26 and the shaft support housing member 13. In the housing 11, the back-pressure chamber 45 is located on the opposite side of the orbiting base plate 26*a* from the fixed base plate 25*a*. The shaft support housing member 13 separates the back-pressure chamber 45 from the motor chamber 20. The inside of the shaft support housing peripheral wall 18 forms part of the back-pressure chamber 45. The gap between the elastic plate 30 and the shaft support housing member 13 forms part of the back-pressure chamber 45.

The orbiting scroll 26 includes an air supply passage 46. The first end of the air supply passage 46 opens in the distal end of the orbiting volute wall 26*b*. The first end of the air supply passage 46 is connectable to the compression chamber 27. The second end of the air supply passage 46 is connected to the back-pressure chamber 45. The air supply passage 46 passes through an inner end of the orbiting volute wall 26*b*, which converges spirally toward the center of the orbiting scroll 26, and the orbiting base plate 26*a*.

The air supply passage 46 supplies part of the refrigerant compressed in the compression chamber 27 to the back-pressure chamber 45. Thus, the pressure in the back-pressure chamber 45 is higher than that in the motor chamber 20. An increase in the back-pressure chamber 45 urges the orbiting scroll 26 toward the fixed scroll 25 such that the distal end of the orbiting volute wall 26*b* is pressed against the fixed base plate 25*a*. Thus, the refrigerant for urging the orbiting scroll 26 toward the fixed scroll 25 is introduced into the back-pressure chamber 45.

Suction Passage

The housing 11 includes a suction passage 50. The refrigerant in the motor chamber 20 is drawn into the compression chamber 27 through the suction passage 50. The suction passage 50 includes a suction groove 51, a first suction hole 52, an annular passage 54, and a second suction hole 55.

Multiple suction grooves 51 are arranged in the inner surface of the motor housing peripheral wall 12*b* of the motor housing member 12. Each suction groove 51 is located in an opening end portion of the inner surface of the motor housing peripheral wall 12*b*. Each suction groove 51 is open in an opening end of the motor housing peripheral wall 12*b*.

One first suction hole 52 is provided in the outer periphery of the flange wall 19 of the shaft support housing member 13. Accordingly, the first suction hole 52 is located in the shaft support housing member 13. The first suction hole 52 extends through the flange wall 19 in its thickness direction. The first suction hole 52 is connected to one of the suction grooves 51. Thus, the first suction hole 52 is connected to the motor chamber 20 through the suction groove 51.

As shown in FIGS. 1 and 2, multiple connection grooves 53 are arranged in the inner surface of the discharge housing peripheral wall 14*b*. As shown in FIG. 2, one of the connection grooves 53 is connected to the first suction hole 52. The annular passage 54 is located between the fixed peripheral wall 25*c* and the discharge housing peripheral wall 14*b*. The connection grooves 53 define the annular passage 54 together with the fixed peripheral wall 25*c*. The annular passage 54 is connected to the first suction hole 52.

One second suction hole 55 is provided in the fixed peripheral wall 25*c*. The second suction hole 55 is provided in the fixed peripheral wall 25*c* so as to extend through the fixed peripheral wall 25*c* in its thickness direction. The second suction hole 55 is connected to the annular passage 54. The second suction hole 55 is connected to the outermost peripheral portion of the compression chamber 27. Thus, the suction passage 50 connects the motor chamber 20 to the compression chamber 27.

Referring to FIG. 1, the refrigerant in the motor chamber 20 is drawn into the compression chamber 27 through the suction groove 51, the first suction hole 52, the annular passage 54, and the second suction hole 55. The refrigerant drawn into the compression chamber 27 is compressed in the compression chamber 27 by orbital motion of the orbiting scroll 26.

As shown in FIG. 2, the straight line that intersects the axis L1 of the rotary shaft 15 and extends vertically, as viewed in the axial direction of the rotary shaft 15, is referred to as a first straight line L11. The straight line that intersects the axis L1 of the rotary shaft 15 and extends with an inclination of 30 degrees toward one side in the circumferential direction of the rotary shaft 15 with respect to the first straight line L11, as viewed in the axial direction of the rotary shaft 15, is referred to as a second straight line L12. The straight line that intersects the axis L1 of the rotary shaft 15 and extends with an inclination of 30 degrees toward the other side in the circumferential direction of the rotary shaft 15 with respect to the first straight line L11, as viewed in the axial direction of the rotary shaft 15, is referred to as a third straight line L13. In FIG. 2, the second straight line L12 is inclined in the clockwise direction with respect to the first straight line L11. The third straight line L13 is inclined in the counterclockwise direction with respect to the first straight line L11.

The discharge housing peripheral wall 14*b* includes the inner surface defining the annular passage 54. The inner surface of the discharge housing peripheral wall 14*b* includes a lower portion located vertically below the axis L1 of the rotary shaft 15 and an upper portion located vertically above the axis L1 of the rotary shaft 15. The intersection of the lower portion of the inner surface of the discharge housing peripheral wall 14*b* and the second straight line L12, as viewed in the axial direction of the rotary shaft 15, is defined as a first intersection P1. The intersection of the lower portion of the inner surface of the discharge housing peripheral wall 14*b* and the third straight line L13, as viewed in the axial direction of the rotary shaft 15, is defined as a second intersection P2. The straight line passing through the first intersection P1 and the second intersection P2 and extending horizontally, as viewed in the axial direction of the rotary shaft 15, is defined as a fourth straight line L14.

The straight line that intersects the axis L1 of the rotary shaft 15 and extends horizontally, as viewed in the axial direction of the rotary shaft 15, is referred to as a fifth straight line L15. The intersection of the upper portion of the inner surface of the discharge housing peripheral wall 14*b* and the second straight line L12, as viewed in the axial direction of the rotary shaft 15, is defined as a third intersection P3. The intersection of the upper portion of the inner surface of the discharge housing peripheral wall 14*b* and the third straight line L13, as viewed in the axial direction of the rotary shaft 15, is defined as a fourth intersection P4. The straight line passing through the third intersection P3 and the fourth intersection P4 and extending horizontally, as viewed in the axial direction of the rotary shaft 15, is defined as a sixth straight line L16.

The first suction hole 52 is connected to one of the connection grooves 53 that is located vertically above the axis L1 of the rotary shaft 15 and between the second straight line L12 and the third straight line L13. The second suction hole 55 is located in a portion of the fixed peripheral wall 25*c* that is positioned vertically above the axis L1 of the rotary shaft 15 and between the second straight line L12 and the third straight line L13.

Opening

The orbiting volute wall 26*b* includes an inner end that spirally converges toward the center of the orbiting scroll 26 and a wrapping end 26*f* of the orbiting volute wall 26*b* on the opposite side of the inner end. An opening 56 is provided between the fixed volute wall 25*b* and the wrapping end 26*f* of the orbiting volute wall 26*b*. As shown in FIG. 2, a hypothetical circle C11 hypothetically depicts a trajectory through which the wrapping end 26*f* of the orbiting volute wall 26*b* passes when the orbiting scroll 26 orbits. The hypothetical circle C11 is located vertically above the axis L1 of the rotary shaft 15 and between the second straight line L12 and the third straight line L13. Thus, when the orbiting scroll 26 orbits, the wrapping end 26*f* of the orbiting volute wall 26*b* is positioned vertically above the axis L1 of the rotary shaft 15 and between the second straight line L12 and the third straight line L13. As a result, the opening 56 is located vertically above the axis L1 of the rotary shaft 15 and between the second straight line L12 and the third straight line L13.

Liquid Refrigerant Reservoir

The scroll compressor 10 includes a liquid refrigerant reservoir 57. The liquid refrigerant reservoir 57 is located in the annular passage 54. The liquid refrigerant reservoir 57 stores liquid refrigerant generated by condensation of the refrigerant in the annular passage 54 while limiting suction of the liquid refrigerant from the annular passage 54 into the compression chamber 27 through the second suction hole 55. The region of the annular passage 54 vertically below the sixth straight line L16, as the annular passage 54 is viewed in the axial direction of the rotary shaft 15, is the liquid refrigerant reservoir 57. Accordingly, the region of the annular passage 54 vertically below the fifth straight line L15, as the annular passage 54 is viewed in the axial direction of the rotary shaft 15, is the liquid refrigerant reservoir 57. Thus, the region of the annular passage 54 vertically below the fourth straight line L14, as the annular passage 54 is viewed in the axial direction of the rotary shaft 15, is the liquid refrigerant reservoir 57.

The second suction hole 55 is located in a portion of the fixed peripheral wall 25*c* that is positioned vertically above the liquid refrigerant reservoir 57. The first suction hole 52 is located in a portion of the shaft support housing member 13 that is positioned vertically above the liquid refrigerant reservoir 57.

Oil Introduction Passage

As shown in FIG. 1, the lower portion of the motor chamber 20 is an oil reservoir 58. The oil reservoir 58 stores oil contained in refrigerant. The scroll compressor 10 includes an oil introduction passage 59. As shown in FIGS. 1 and 2, the oil introduction passage 59 includes a reduced-diameter hole 60 and an oil suction port 61. The reduced-diameter hole 60 is located in the shaft support housing member 13. The reduced-diameter hole 60 connects the oil reservoir 58 to the annular passage 54.

As shown in FIG. 2, the reduced-diameter hole 60 is connected to one of the connection grooves 53 that is located vertically below the axis L1 of the rotary shaft 15 and between the second straight line L12 and the third straight line L13. The reduced-diameter hole 60 is connected to the region of the annular passage 54 vertically below the fourth straight line L14 as the annular passage 54 is viewed in the axial direction of the rotary shaft 15.

The oil suction port 61 is located in the fixed peripheral wall 25*c*. Specifically, the oil suction port 61 is located in a portion of the fixed peripheral wall 25*c* that is positioned in a region vertically below the fourth straight line L14 as the fixed peripheral wall 25*c* is viewed in the axial direction of the rotary shaft 15. The oil suction port 61 extends through the fixed peripheral wall 25*c* in the radial direction of the rotary shaft 15. The oil suction port 61 connects the annular passage 54 to the inside of the fixed peripheral wall 25*c*. The oil introduction passage 59 introduces the oil stored in the oil reservoir 58 to the inside of the fixed peripheral wall 25*c*.

Operation of the Embodiment

The operation of the present embodiment will now be described.

In the scroll compressor 10 of the present embodiment, the refrigerant in the annular passage 54 may be cooled and condensed when the scroll compressor 10 is stopped. The liquid refrigerant generated in the annular passage 54 is stored in the liquid refrigerant reservoir 57 in the annular passage 54. In the present embodiment, the second suction hole 55 is located in the portion of the fixed peripheral wall 25*c* that is positioned vertically above the liquid refrigerant reservoir 57. This limits situations in which the liquid refrigerant generated in the annular passage 54 is drawn into the compression chamber 27 through the second suction hole 55. Thus, the occurrence of liquid compression in the compression chamber 27 is limited. Further, introduction of liquid refrigerant into the back-pressure chamber 45 from the compression chamber 27 through the air supply passage 46 is limited.

A pressure difference between the pressure in the annular passage 54 and the pressure inside the fixed peripheral wall 25*c* increases and decreases as the orbiting scroll 26 orbits. When the inner pressure of the fixed peripheral wall 25*c* decreases, oil is supplied from the oil reservoir 58 to the annular passage 54 through the reduced-diameter hole 60. Then, the oil supplied to the annular passage 54 is drawn from the oil suction port 61 and reaches the inside of the fixed peripheral wall 25*c*. In this manner, the oil in the oil reservoir 58 is intermittently introduced to the inside of the fixed peripheral wall 25*c* through the oil introduction passage 59. Accordingly, lubrication between the fixed scroll 25 and the orbiting scroll 26 is improved.

Even if, for example, liquid refrigerant accumulates in the lower portion of the motor chamber 20, the liquid refrigerant intermittently flows to the inside of the fixed peripheral wall 25*c* through the oil introduction passage 59. Thus, even if the scroll compressor 10 includes the oil introduction passage 59, the suction of liquid refrigerant into the compression chamber 27 is limited.

Advantages of the Embodiment

The above-described embodiment provides the following advantages.

(1) The liquid refrigerant generated by the condensation of refrigerant in the annular passage 54 is stored in the liquid refrigerant reservoir 57, which is located inside the annular passage 54. In the present embodiment, the second suction hole 55 is located in the portion of the fixed peripheral wall 25*c* that is positioned vertically above the liquid refrigerant reservoir 57. This limits situations in which the liquid refrigerant generated in the annular passage 54 is drawn into the compression chamber 27 through the second suction hole 55. Accordingly, the occurrence of liquid compression in the compression chamber 27 is limited, so that an abnormal increase in the pressure in the compression chamber 27 is limited. This limits deterioration of the durability of the compression mechanism C1. As a result, the reliability of the scroll compressor 10 is improved.

(2) The scroll compressor 10 is configured to limit situations in which the liquid refrigerant generated in the annular passage 54 is drawn into the compression chamber 27 through the second suction hole 55 regardless of the formation of the air supply passage 46 in the orbiting scroll 26. This limits situations in which liquid refrigerant flows from the compression chamber 27 through the air supply passage 46 into the back-pressure chamber 45. As a result, an excessive increase in the pressure in the back-pressure chamber 45 that would be caused by vaporization of the liquid refrigerant in the back-pressure chamber 45 is limited.

(3) The second suction hole 55 is located in the portion of the fixed peripheral wall 25*c* that is positioned vertically above the axis L1 of the rotary shaft 15 and between the second straight line L12 and the third straight line L13. The opening 56, which is provided between the fixed volute wall 25*b* and the wrapping end 26*f* of the orbiting volute wall 26*b*, is located vertically above the axis L1 of the rotary shaft 15 and between the second straight line L12 and the third straight line L13. This facilitates the flow of the refrigerant drawn from the second suction hole 55 into the opening 56, which is provided between the fixed volute wall 25*b* and the wrapping end 26*f* of the orbiting volute wall 26*b*. This allows the refrigerant to be efficiently drawn into the compression chamber 27, thereby improving the compression efficiency of the scroll compressor 10.

(4) The first suction hole 52 is located in the portion of the shaft support housing member 13 that is positioned vertically above the liquid refrigerant reservoir 57. Accordingly, the flow of liquid refrigerant, which is generated when refrigerant is condensed in the motor chamber 20, into the annular passage 54 through the first suction hole 52 is limited more easily. This further limits situations in which liquid refrigerant is drawn into the compression chamber 27.

(5) The lower portion of the motor chamber 20 is the oil reservoir 58, which stores oil contained in refrigerant. The scroll compressor 10 includes the oil introduction passage 59, which introduces the oil stored in the oil reservoir 58 to the inside of the fixed peripheral wall 25*c*. This allows the oil stored in the lower portion of the oil reservoir 58 to be introduced to the inside of the fixed peripheral wall 25*c* through the oil introduction passage 59. Thus, lubrication between the fixed scroll 25 and the orbiting scroll 26 is improved.

(6) The pressure difference between the pressure in the annular passage 54 and the pressure inside the fixed peripheral wall 25*c* increases and decreases as the orbiting scroll 26 orbits. When the inner pressure of the fixed peripheral wall 25*c* decreases, oil is supplied from the oil reservoir 58 to the annular passage 54 through the reduced-diameter hole 60. Then, the oil supplied to the annular passage 54 is drawn from the oil suction port 61 and reaches the inside of the fixed peripheral wall 25*c*. In this manner, the oil stored in the oil reservoir 58 is intermittently introduced to the inside of the fixed peripheral wall 25*c* through the oil introduction passage 59. Even if, for example, liquid refrigerant accumulates in the lower portion of the motor chamber 20, the liquid refrigerant intermittently flows to the inside of the fixed peripheral wall 25*c* through the oil introduction passage 59. Thus, even if the scroll compressor 10 includes the oil introduction passage 59, the suction of liquid refrigerant into the compression chamber 27 is limited. This improves lubrication between the fixed scroll 25 and the orbiting scroll 26 while limiting the occurrence of liquid compression in the compression chamber 27.

(7) The region of the annular passage 54 vertically below the fifth straight line L15, as the annular passage 54 is viewed in the axial direction of the rotary shaft 15, is the liquid refrigerant reservoir 57. Accordingly, the liquid refrigerant generated by the condensation of refrigerant in the annular passage 54 is more easily stored in the liquid refrigerant reservoir 57, which is located inside the annular passage 54. Thus, situations in which the liquid refrigerant generated in the annular passage 54 is drawn into the compression chamber 27 through the second suction hole 55 are limited more effectively. As a result, the occurrence of liquid pressure in the compression chamber 27 is limited more effectively.

(8) The region of the annular passage 54 vertically below the sixth straight line L16, as the annular passage 54 is viewed in the axial direction of the rotary shaft 15, is the liquid refrigerant reservoir 57. Accordingly, the liquid refrigerant generated by the condensation of refrigerant in the annular passage 54 is more easily stored in the liquid refrigerant reservoir 57, which is located inside the annular passage 54. Thus, situations in which the liquid refrigerant generated in the annular passage 54 is drawn into the compression chamber 27 through the second suction hole 55 are limited more effectively. As a result, the occurrence of liquid pressure in the compression chamber 27 is limited more effectively.

Modifications

The above-described embodiment may be modified as follows. The above-described embodiment and the following modifications can be combined as long as the combined modifications remain technically consistent with each other.

In the embodiment, the second suction hole 55 may be located in the portion of the fixed peripheral wall 25*c* that is positioned between the fifth straight line L15 and the sixth straight line L16 as the fixed peripheral wall 25*c* is viewed in the axial direction of the rotary shaft 15. In this case, the first suction hole 52 may be connected to one of the connection grooves 53 that is located between the fifth straight line L15 and the sixth straight line L16 and corresponds to the second suction hole 55. Even in such a case, the region of the annular passage 54 vertically below the fifth straight line L15, as the annular passage 54 is viewed in the axial direction of the rotary shaft 15, is the liquid refrigerant reservoir 57.

In the embodiment, the second suction hole 55 may be located in the portion of the fixed peripheral wall 25*c* that is positioned between the fourth straight line L14 and the fifth straight line L15 as the fixed peripheral wall 25*c* is viewed in the axial direction of the rotary shaft 15. In this case, the first suction hole 52 may be connected to one of the connection grooves 53 that is located between the fourth straight line L14 and the fifth straight line L15 and corresponds to the second suction hole 55. Even in such a case, the region of the annular passage 54 vertically below the fourth straight line L14, as the annular passage 54 is viewed in the axial direction of the rotary shaft 15, is the liquid refrigerant reservoir 57. That is, the second suction hole 55 does not have to be located in the portion of the fixed peripheral wall 25*c* that is positioned vertically above the axis L1 of the rotary shaft 15 and between the second straight line L12 and the third straight line L13. The second suction hole 55 only needs to be located in the portion of the fixed peripheral wall 25*c* that is positioned vertically above the liquid refrigerant reservoir 57. As the annular passage 54 is viewed in the axial direction of the rotary shaft 15, at least the region vertically below the fourth straight line L14 needs to be the liquid refrigerant reservoir 57.

In the embodiment, the second suction hole 55 does not have to be located in the portion of the fixed peripheral wall 25*c* that is positioned vertically above the axis L1 of the rotary shaft 15 and between the second straight line L12 and the third straight line L13. In this case, the opening 56, which is provided between the fixed volute wall 25*b* and the wrapping end 26*f* of the orbiting volute wall 26*b*, does not have to be located vertically above the axis L1 of the rotary shaft 15 and between the second straight line L12 and the third straight line L13.

In the embodiment, the first suction hole 52 does not have to be located in the portion of the shaft support housing member 13 that is positioned vertically above the liquid refrigerant reservoir 57.

In the embodiment, the oil introduction passage 59 does not have to include the oil suction port 61. For example, the first end of the reduced-diameter hole 60 may be connected to the oil reservoir 58, and the second end of the reduced-diameter hole 60 may be connected to the inside of the fixed peripheral wall 25*c*.

In the embodiment, the scroll compressor 10 does not have to include the oil introduction passage 59.

In the embodiment, the number of the first suction holes 52 is not particularly limited.

In the embodiment, the number of the second suction holes 55 is not particularly limited.

In the embodiment, the scroll compressor 10 does not have to be driven by the motor 22 and may be driven by, for example, the engine of a vehicle.

In the above-described embodiment, the scroll compressor 10 is used in the vehicle air conditioner. However, the scroll compressor 10 may be used in other apparatuses. The scroll compressor 10 may be any type of compressor that compresses refrigerant, and its application may be varied.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A scroll compressor, comprising:

a rotary shaft;

a compression mechanism configured to be driven by rotation of the rotary shaft, the compression mechanism including a compression chamber configured to compress refrigerant; and a housing rotatably supporting the rotary shaft, the housing including a suction chamber into which refrigerant is drawn from outside, a discharge chamber from which the refrigerant compressed in the compression chamber is discharged, and a suction passage through which the refrigerant drawn from the suction chamber into the compression chamber passes, wherein the compression mechanism includes:

a fixed scroll fixed to the housing, the fixed scroll including a fixed base plate, a fixed volute wall extending from the fixed base plate in an axial direction of the rotary shaft, and a fixed peripheral wall extending from the fixed base plate in the axial direction of the rotary shaft and surrounding the fixed volute wall; and an orbiting scroll configured to orbit inside the fixed peripheral wall in response to rotation of the rotary shaft, the orbiting scroll including an orbiting base plate opposing the fixed base plate and an orbiting volute wall extending from the orbiting base plate toward the fixed base plate and meshing with the fixed volute wall, the compression chamber is defined by the fixed base plate, the fixed volute wall, the orbiting base plate, and the orbiting volute wall, the housing includes:

a shaft support housing member that is disposed on an opposite side of the orbiting base plate from the fixed base plate and supports the rotary shaft; and a discharge housing member including a discharge housing end wall and a cylindrical discharge housing peripheral wall extending from the discharge housing end wall to surround the fixed peripheral wall, the discharge housing member defining the discharge chamber between the discharge housing end wall and the fixed base plate, the suction passage includes:

a first suction hole located in the shaft support housing member and connected to the suction chamber;

an annular passage located between the fixed peripheral wall and the discharge housing peripheral wall and connected to the first suction hole; and a second suction hole located in the fixed peripheral wall and connected to the annular passage, the discharge housing peripheral wall includes an inner surface that defines the annular passage, the inner surface including a lower portion located vertically below an axis of the rotary shaft, as viewed in the axial direction of the rotary shaft, a straight line intersecting the axis of the rotary shaft and extending vertically is a first straight line, a straight line intersecting the axis of the rotary shaft and extending with an inclination of 30 degrees toward one side in a circumferential direction of the rotary shaft with respect to the first straight line is a second straight line, a straight line intersecting the axis of the rotary shaft and extending with an inclination of 30 degrees toward the other side in the circumferential direction of the rotary shaft with respect to the first straight line is a third straight line, an intersection of the lower portion of the inner surface and the second straight line is a first intersection, an intersection of the lower portion of the inner surface and the third straight line is a second intersection, and a straight line passing through the first intersection and the second intersection and extending horizontally is a fourth straight line, as the annular passage is viewed in the axial direction of the rotary shaft, a region of the annular passage vertically below the fourth straight line is a liquid refrigerant reservoir, the liquid refrigerant reservoir is configured to store liquid refrigerant generated by condensation of the refrigerant in the annular passage while limiting suction of the liquid refrigerant from the annular passage into the compression chamber through the second suction hole, and the second suction hole is located in a portion of the fixed peripheral wall that is positioned vertically above the liquid refrigerant reservoir.

2. The scroll compressor according to claim 1, wherein a back-pressure chamber, into which refrigerant for urging the orbiting scroll toward the fixed scroll is introduced, is defined between the orbiting base plate and the shaft support housing member, and the orbiting scroll includes a supply passage configured to supply part of the refrigerant compressed in the compression chamber to the back-pressure chamber.

3. The scroll compressor according to claim 1, wherein the second suction hole is located in a portion of the fixed peripheral wall that is positioned vertically above the axis of the rotary shaft and between the second straight line and the third straight line, and an opening between the fixed volute wall and a wrapping end of the orbiting volute wall is located vertically above the axis of the rotary shaft and between the second straight line and the third straight line.

4. The scroll compressor according to claim 1, wherein the first suction hole is located in a portion of the shaft support housing member that is positioned vertically above the liquid refrigerant reservoir.

5. The scroll compressor according to claim 1, wherein a lower portion of the suction chamber is an oil reservoir that stores oil contained in refrigerant, and the scroll compressor further comprises an oil introduction passage configured to introduce the oil stored in the oil reservoir to an inside of the fixed peripheral wall.

6. The scroll compressor according to claim 5, wherein the oil introduction passage includes:

a reduced-diameter hole located in the shaft support housing member, the reduced-diameter hole connecting the oil reservoir to the annular passage; and an oil suction port located in the fixed peripheral wall, the oil suction port connecting the annular passage to the inside of the fixed peripheral wall.

7. The scroll compressor according to claim 1, wherein as viewed in the axial direction of the rotary shaft, a straight line intersecting the axis of the rotary shaft and extending horizontally is a fifth straight line, and as the annular passage is viewed in the axial direction of the rotary shaft, a region of the annular passage vertically below the fifth straight line is the liquid refrigerant reservoir.

8. The scroll compressor according to claim 7, wherein the inner surface of the discharge housing peripheral wall includes an upper portion located vertically above the axis of the rotary shaft, an intersection of the upper portion of the inner surface and the second straight line is a third intersection, an intersection of the upper portion of the inner surface and the third straight line is a fourth intersection, a straight line passing through the third intersection and the fourth intersection and extending horizontally is a sixth straight line, and as the annular passage is viewed in the axial direction of the rotary shaft, a region of the annular passage vertically below the sixth straight line is the liquid refrigerant reservoir.

* * * * *